US005762231A

United States Patent [19]

Rider, Jr. et al.

[11] Patent Number: 5,762,231

[45] Date of Patent: Jun. 9, 1998

[54] COMPARTMENTALIZED CONTAINER

[75] Inventors: Edward W. Rider, Jr., Slate Hill; Alex Augustin, Sparrowbush, both of N.Y.

[73] Assignee: Genpak Corporation, Glens Falls, N.Y.

[21] Appl. No.: 940,671

[22] Filed: Sep. 30, 1997

Related U.S. Application Data

[63] Continuation of Ser. No. 649,294, May 17, 1996, abandoned.

[51] Int. Cl.[6] ..... B65D 25/04; B65D 43/04

[52] U.S. Cl. ..... 220/526; 206/541; 220/786; 220/793; 426/124

[58] Field of Search ..... 206/541, 545, 206/561; 220/4.21, 4.22, 23.83, 23.86, 523, 524, 526, 555, 556, 575, 783–792; 426/119, 120, 124

[56] References Cited

U.S. PATENT DOCUMENTS

| | | | |
|---|---|---|---|
| D. 232,294 | 8/1974 | Christian et al. | D7/27 |
| 523,361 | 1/1894 | Carabine . | |
| 1,714,772 | 4/1929 | Gabriel . | |
| 1,770,807 | 7/1930 | Rollason . | |
| 1,848,066 | 3/1932 | Shepard et al. . | |
| 2,794,664 | 6/1957 | Kruger | 292/129 |
| 3,016,129 | 1/1962 | King, III | 206/545 |
| 3,107,027 | 10/1963 | Hong | 220/23.8 |
| 3,228,776 | 1/1966 | Savage et al. | 99/171 |
| 3,458,113 | 7/1969 | Swartzbaugh | 229/44 |
| 3,487,972 | 1/1970 | Swett | 220/780 |
| 3,556,815 | 1/1971 | Fujiwara | 99/171 |
| 3,595,425 | 7/1971 | Eicholtz | 220/20 |
| 3,645,758 | 2/1972 | MacManus | 99/172 |
| 3,767,110 | 10/1973 | Congleton | 229/45 |
| 3,786,982 | 1/1974 | Rakes et al. | 229/2.5 |
| 3,984,027 | 10/1976 | Smith | 220/786 |
| 4,020,946 | 5/1977 | Gardner et al. | 206/45.16 |
| 4,079,880 | 3/1978 | Edwards | 220/4.21 |
| 4,081,646 | 3/1978 | Goltsos | 426/107 |
| 4,143,805 | 3/1979 | Sutton | 220/4.21 |
| 4,190,155 | 2/1980 | Higley | 206/545 |
| 4,298,133 | 11/1981 | Davis | 220/306 |
| 4,592,468 | 6/1986 | Wallace | 206/387 |
| 4,653,685 | 3/1987 | Leary et al. | 220/4.21 |
| 4,687,117 | 8/1987 | Terauds | 220/784 |
| 4,838,444 | 6/1989 | Bitel | 220/4 E |
| 5,031,768 | 7/1991 | Fischer | 206/370 |
| 5,094,355 | 3/1992 | Clark et al. | 220/4.23 |
| 5,236,119 | 8/1993 | Chu | 229/2.5 R |
| 5,377,860 | 1/1995 | Littlejohn et al. | 220/784 |

*Primary Examiner*—Jimmy G. Foster

*Attorney, Agent, or Firm*—Heslin & Rothenberg, P.C.; Wayne F. Reinke, Esq.

[57] ABSTRACT

A tabless container closure for a compartmentalized container with a cover and a base. The cover includes a sidewall and a rim coupled thereto. The rim has a depression that fits within an opening in a sidewall of the base. The rim depression and opening provide a snap-fit closure to releasably connect the cover and base. In a second aspect, the compartments of the container are closed off from one another such that the contents of a given compartment substantially remain therein, even after a perturbation of the container. In a third aspect, a divider separating the compartments is bowed to enhance the structural integrity of the base.

9 Claims, 11 Drawing Sheets

COMPARTMENTALIZED CONTAINER

This application is a continuation of application Ser. No. 08/649,294 filed May 17, 1996, now abandoned.

BACKGROUND OF THE INVENTION

This application contains subject matter which is related to the subject matter of the following applications which are assigned to the same assignee as this application, and which are being filed concurrently herewith:

"Food Dish," by Rider, Jr. et al., Design Pat No. Des.380, 648; and

"Tabless Container Closure," by Rider, Jr. et al., Ser. No. 08/649,314, pending.

TECHNICAL FIELD

The present invention generally relates to containers. More particularly, the present invention relates to compartmentalized containers.

BACKGROUND INFORMATION

In the past, compartmentalized containers, particularly disposable compartmentalized food containers have suffered many shortcomings. For example, food in one compartment has leaked into another when the container experiences a physical perturbation. As another example, containers including a male/female closure have relied on a tab or extension straight out from the wall of the container top. This type of closure can be cumbersome, since the tab and/or container must be deformed enough to allow the tab to clear the female component before entry. In addition, this excess deformation could damage the container.

As still another example, such containers have suffered from a lack of structural integrity. This is particularly true for thermoformed containers with a linear compartment divider running from one side of the container to the opposite side. Since thermoformed containers often follow the outline of the shape of the compartments, similar to an egg carton, a linear divider across a container may bend easily under a load, leading to container collapse. This problem has been addressed by lowering the divider height, often below half the height of the sidewall. Lowering the divider height increases the sidewall surface area above the divider, with a corresponding increase in structural integrity. However, while a reduction in divider height addresses the collapsing problem, it limits the possible depth of the individual compartments.

Thus, a need exists for an improved compartmentalized container that reduces or eliminates leakage between compartments, reduces the amount of deformation and effort needed to close the container, and discourages collapse under a load while not restricting the depth of the individual compartments.

SUMMARY OF THE INVENTION

Briefly, the present invention satisfies the need for a an improved compartmentalized container by providing one with a compartment close-off feature, an indentation in a peripheral rim that provides a snap fit with a female closure component, and a bowed compartment divider to improve the structural integrity of the container.

In accordance with the above, it is an object of the present invention to provide a compartmentalized container where the compartments are effectively closed off from each other.

It is another object of the present invention to provide a compartmentalized container closure that reduces the need to deform the container as compared to a male/female container closure with a tab or extension out from a sidewall as the male component.

It is a further object of the present invention to provide a compartmentalized container with a structure that discourages container collapse under a load.

The present invention provides, in a first aspect, a compartmentalized container, comprising a base with at least two compartments, and a cover for covering the base. When the base and cover are joined, the compartments remain segregated such that during a perturbation of the container, any contents present within a given compartment are substantially retained therein.

The present invention provides, in a second aspect, a compartmentalized container of the first aspect with a new closure mechanism. One of the base and cover includes a sidewall having an outwardly extending rim coupled thereto at a periphery thereof. The outwardly extending rim includes an indentation, and the other portion includes a sidewall having an opening therein for receiving the indentation. The cover and base are releasably connected when the opening receives the indentation.

The present invention provides, in a third aspect, a container of the first aspect, wherein the base further comprises: a noncontinuous bottom surface; a noncontinuous sidewall extending up from a periphery of the noncontinuous bottom surface; and a nonlinear divider creating at least two compartments in!the container. The nonlinear divider begins at the noncontinuous bottom surface and terminates between a midpoint and a top of the noncontinuous sidewall adjacent thereto.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
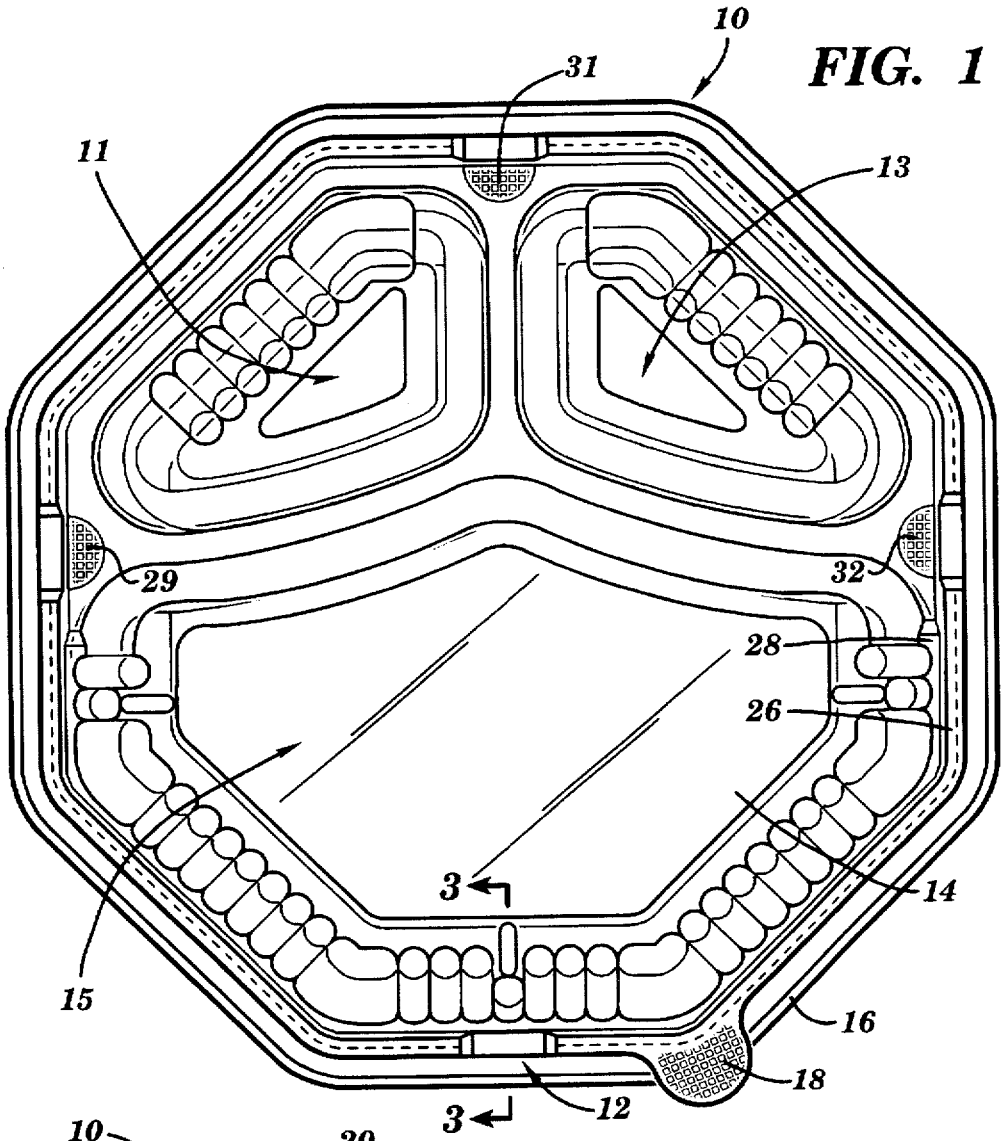
FIG. 1 is a top view of a container according to the present invention.
Figure 2:
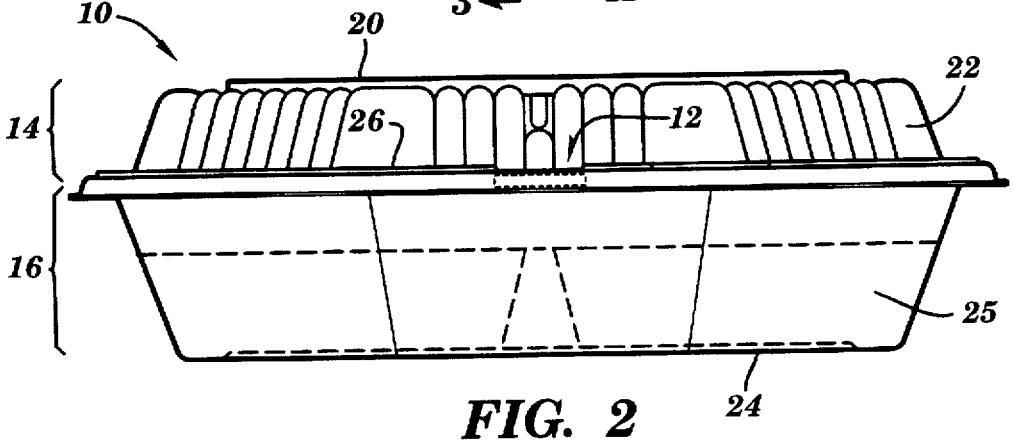
FIG. 2 is a front view of the container of FIG. 1.
Figure 7:
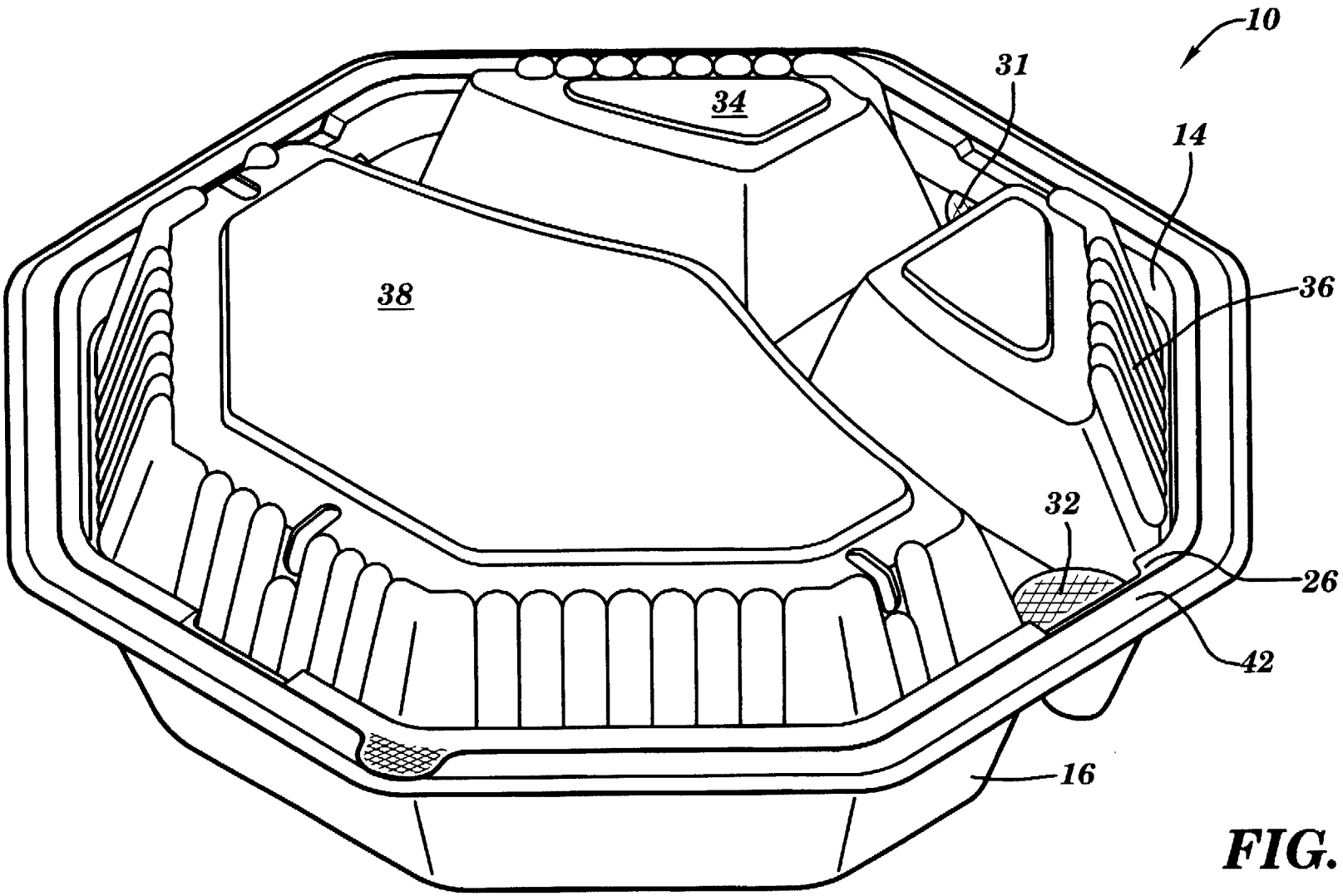
FIG. 7 is a perspective view from above the container of FIG. 1.

FIGS. 1 and 2 depict an exemplary food container 10 according to the present invention. In a first aspect of the present invention, a "tabless" container closure is provided, such as container closure 12, shown in more detail in subsequent figures. Container 10 includes cover 14 and base 16. Although shown as two separate pieces, cover 14 and base 16 could be hingedly connected, and there could be fewer or a greater number of container closures. Cover 14 is made of a clear plastic and comprises lifting extension 18, which is a protrusion therefrom with a roughened surface to assist in separating cover 14 from base 16, and raised areas 29, 31 and 32. The raised areas (the raised aspect is best shown in FIG. 7) each have a roughened surface similar to extension 18, and are used to push cover 14 down onto base 16 such that the closures close properly. Since cover 14 is somewhat flexible from compartmentalization (see FIG. 7), the raised areas are helpful in this task. However, if cover 14 were stiff, the raised areas would not be needed. Cover 14 also comprises a top surface 20 with a noncontinuous sidewall 22 depending therefrom. Base 16 comprises a noncontinuous bottom surface 24 and a noncontinuous sidewall 25 extending upward therefrom. As shown in FIG. 1, top portion 14 is made of a transparent plastic, showing compartments 11, 13 and 15 of base 16. However, it need not be transparent or plastic.

Figure 3:
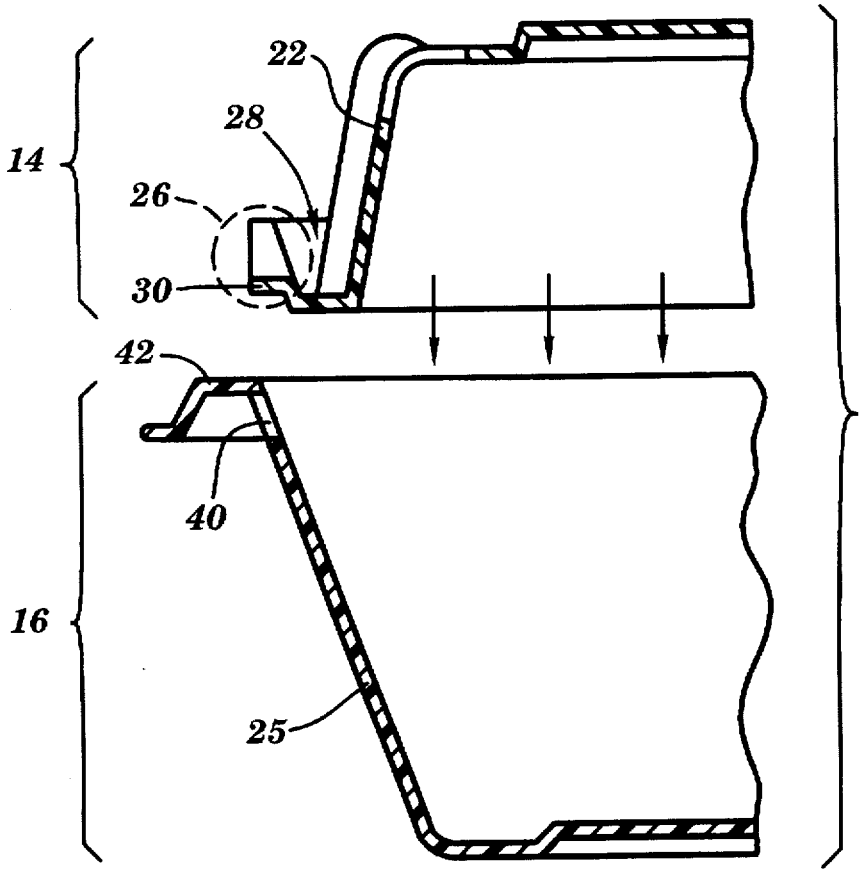
FIG. 3 is a cross-sectional view of the closure portion of the container of FIG. 1 with the container opened.

FIG. 3 is a cross-sectional view showing the components of closure 12 with top 14 and bottom 16 separated. Cover 14 also comprises outwardly extending rim 26 around the periphery thereof. Between the sidewalls and outwardly extending rim 26 is channel 28. Rim 26 comprises several indentations therein, e.g., indentation 30, taking the form of a depression of rim 26. Although four such indentations are present in container 10, it will be understood that there could be a greater or lesser number. In addition, it will also be understood that an indentation of the present invention could also take the form of a raised portion of the rim, and can be different shapes than generally rectangular, as shown best in FIG. 5. Although not required, channel 28 makes it easier to depress rim 26 in particular areas to create the indentations, by creating a gap between the sidewall and rim.

As shown in FIG. 1, lifting extension 18 may take the form of an extension of rim 26. However, the lifting extension could take any form that would assist in separating the cover from the base. Preferably, the lifting extension is included in the container portion that includes the indentations, however, that need not be the case, and there could alternatively be lifting extensions on both container portions laterally displaced from one another. As compared to known male/female container closures, which include tabs or extensions as the male component, the indentation of the present inventive container closure replaces such male components, allowing less deformation of cover 14 before closure is achieved.

FIG. 7 is a perspective view from above container 10. Cover 14 is shown opaque in FIG. 7 for clarity. Cover 14 has three compartments 34, 36 and 38 corresponding to compartments 11, 13 and 15 in base 16, respectively. In this way, the food in the different compartments is segregated to help prevent unwanted intermixing. Although shown in other figures, FIG. 7 best shows the raised nature of the raised areas, e.g., raised area 32, and that the cover outer rim 26 rests on the base rim 42 when the container cover and base are releasably connected.

Referring again to FIG. 1, base 16 is shown in FIG. 1 with three compartments (11, 13 and 15), however, it will be understood that there could be a greater or lesser number, depending on the intended use. For example, if container 10 is to be used to store food, the different compartments could hold and keep separate different food portions comprising the different courses of a meal. In addition, the base is preferably a unitary structure. Also, where cover 14 and base 16 are hingedly connected, container 10 could itself be a unitary structure. Base 16 also comprises several female closure components, e.g., female closure component 40 shown in FIG. 3, corresponding to the indentations of cover 14.

Figure 5:
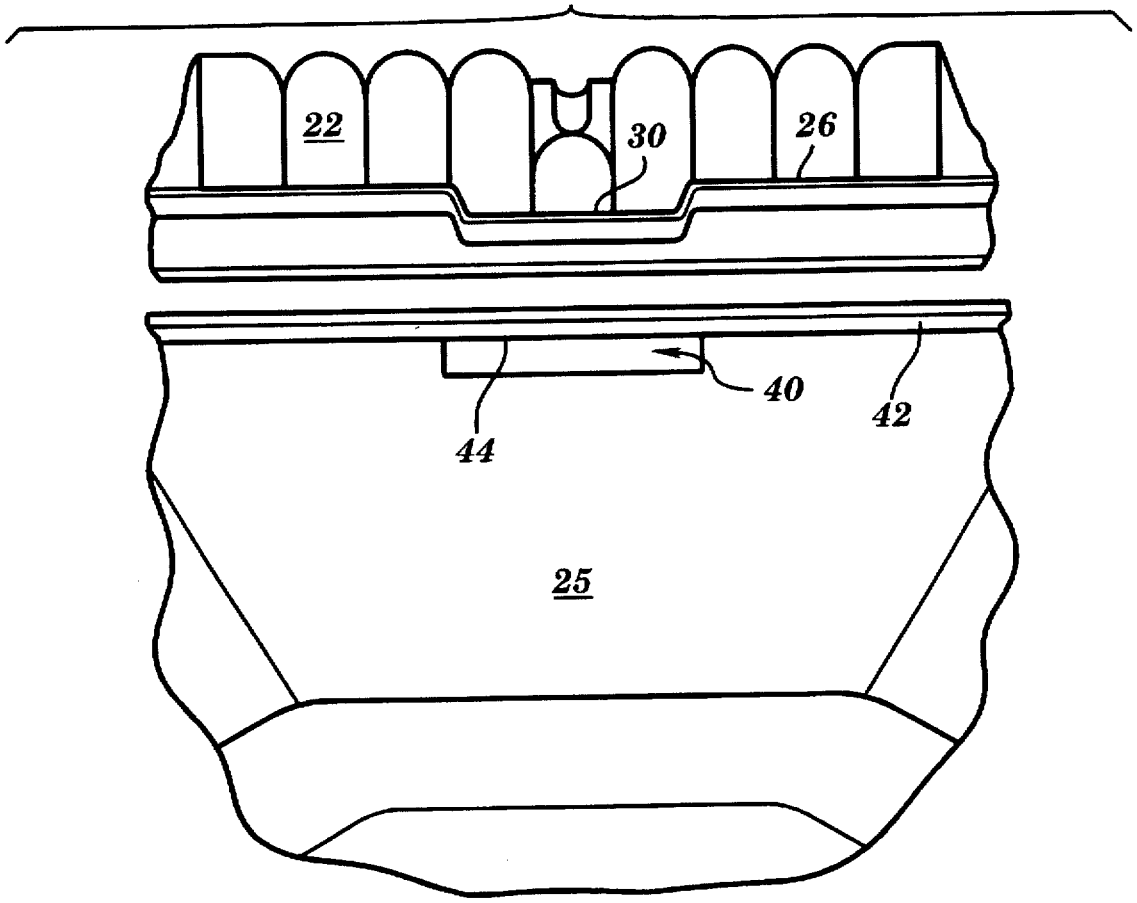
FIG. 5 is an angled view of the closure of FIG. 3 from below the container.

As shown in FIG. 5, the female closure components take the form of generally rectangular openings in the sidewall, where the sidewall meets rim 42. If the material used for the base is more easily deformable than the cover, for example, recyclable plastic for the cover and foam for the base, then the indentations may slightly cut into the top edges, e.g., edge 44, of the openings. Such slight deformations may actually improve conformity of the openings to the indentations. If the base is not made of a more deformable material than the cover, for example, if both portions were made of recyclable plastic, then the openings could be initially shaped to more accurately conform to the indentations, rather than relying on the indentations to mold the openings to their shape.

Figure 4:
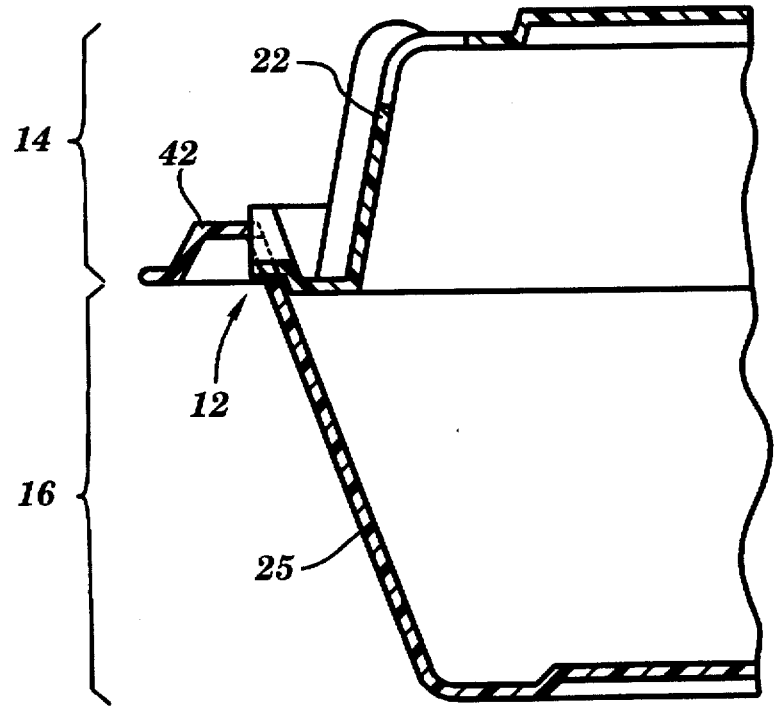
FIG. 4 depicts the closure portion of FIG. 3 with the container closed.
Figure 6:
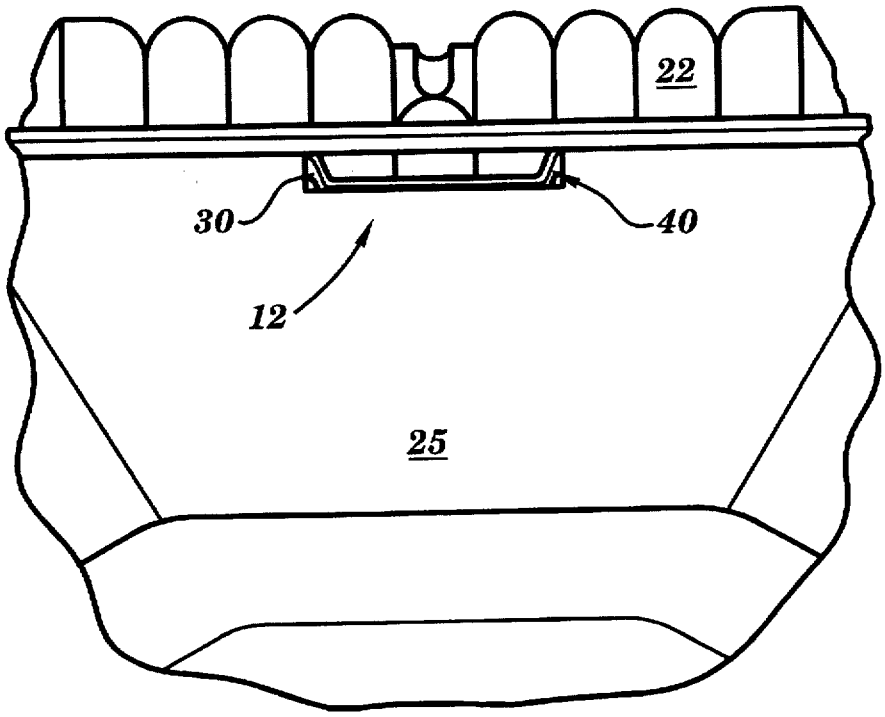
FIG. 6 is an angled view of the closure of FIG. 4 from below the container.

FIGS. 4 and 6 depict cover 14 releasably connected to base 16. A releasable connection is made, for example, when indentation 30 is received by female closure component 40. With respect to container 10, cover 14 is pushed down onto base 16 until a "snap fit" is made between the indentations and their corresponding openings. While the cover is being pushed onto the base for closure, the sidewall 22 of the cover near the indentations deforms slightly, until the indentations are received by the openings. By simply placing the cover over the bottom such that the indentations line up with the openings, and pushing down on the cover, closure of the container is accomplished with minimal effort.

In a second aspect of the present invention, the compartments 11, 13 and 15 of base 16 of container 10 are closed off from each other such that when cover 14 is joined therewith, a perturbation of the container will not lead to the contents, e.g., food, of one compartment ending up in another. For example, it has been found that a liquid or semi-liquid placed in compartment 11 substantially remains therein, even when a perturbation of container 10 is experienced. As used herein, the term "substantially remains" means that for practical purposes, the contents do not leak out from a particular compartment in the wake of a perturbation, although a negligible amount may leak out. However, the amount that may leak out does not generally make the contents of the compartment into which the liquid or semi-liquid leaked unpalatable or otherwise unusable. As used herein, the term "perturbation" refers to a general unwanted movement of the container, such as may be experienced while carrying the container from a cashier to a dining table or an automobile. As an example, a perturbation includes a mild bump to or a slight incline of the container. However, the term "perturbation" is not intended to include actions such as severe blows to the container or repeated inversions or shaking thereof.

Figure 8:
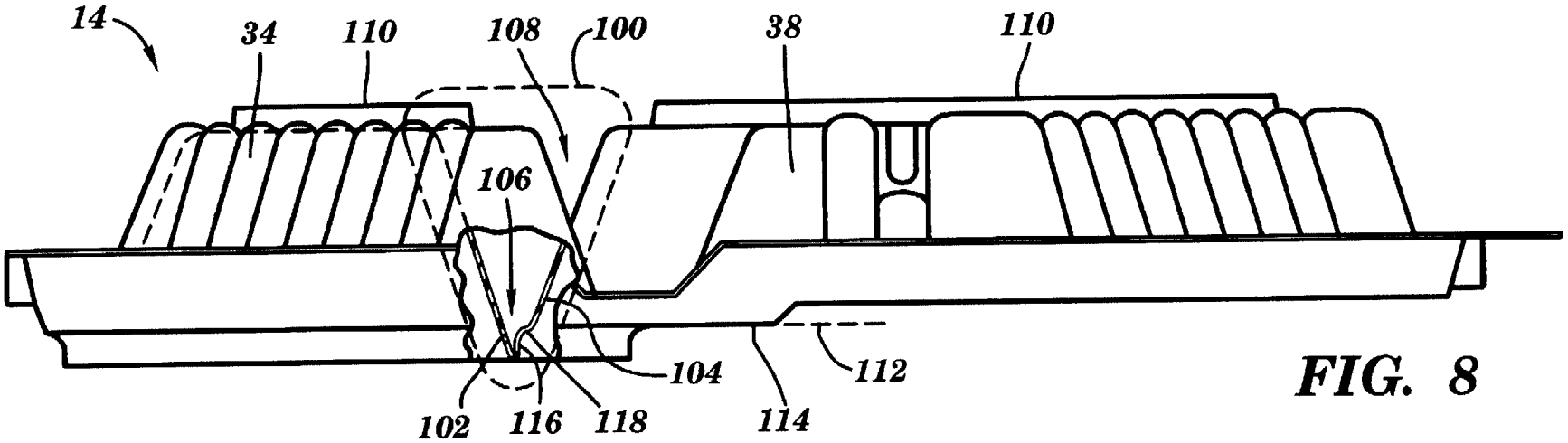
FIG. 8 is a close-up left side view of the container cover of FIG. 1.

FIG. 8 is a left side view of cover 14 from FIG. 1. Shown partially cut away in FIG. 8 is closure member 100 between upper compartments 34 and 38, comprised of sidewall portions 102 and 104, and step 106, with a hollow center 108. Closure member 100 depends from a top surface 110 and extends below a plane 112 created by a bottom peripheral edge 114 of cover 14. Step 106 contacts the divider 218 (see FIG. 11) of base 16, and is shaped to correspond to or mate therewith. Step 106 includes an extension 116 that extends into, e.g., compartment 11 and comes to rest on rim 254 surrounding compartment 11. Step 106 also includes a curved portion 118 that corresponds to the shape of the apex 256 of divider 218. Optionally, there could be a second extension (not shown) on the right side of portion 118, creating a generally U-shaped divider contact area (see FIG. 9).

Figure 9:
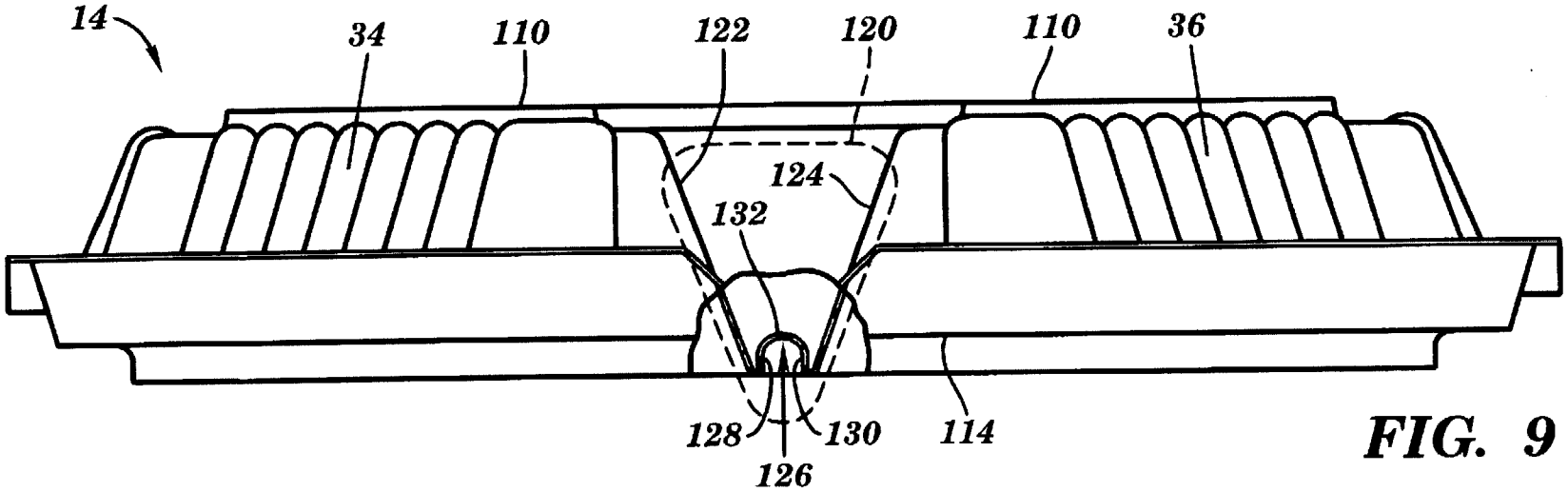
FIG. 9 is a close-up rear view of the container cover of FIG. 1.

FIG. 9 is a rear view of cover 14 from between upper compartments 34 and 36. A second closure member 120 is shown, comprised of sidewall portions 122 and 124, which depend from top surface 110. Closure member 120 also includes a generally U-shaped wall contact area 126, comprised of extensions 128 and 130, and curved portion 132. The shape of wall contact area 126 corresponds to the shape of the apex 258 of divider 224 of base 16, providing a snug fit therewith.

Figure 10:
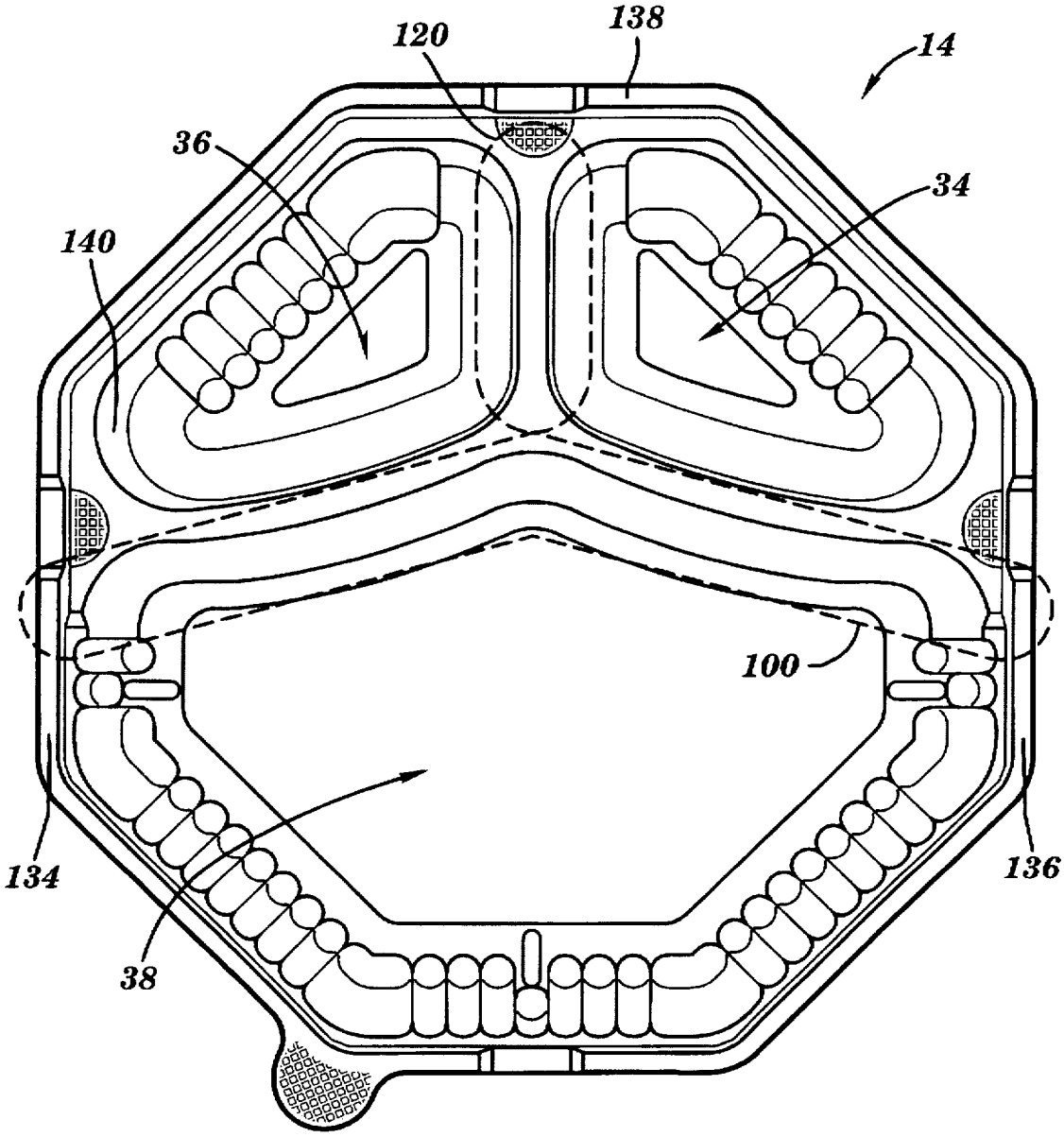
FIG. 10 is a view from the underside of the container cover of FIG. 1.

FIG. 10 is a view from the underside of cover 14. FIG. 10 depicts closure member 100 extending from side 134 of cover 14 to side 136, and closure member 120 extending from side 138 to meet closure member 100. Each of upper compartments 34 and 36 also include a flat surrounding rim, e.g., flat surrounding rim 140, that meets the inner rim of the corresponding compartment in the base, e.g., inner rim 26 surrounding compartment 13.

In a third aspect of the present invention, the bowed nature of divider 218 of base 16 provides improved structural integrity (compared to a linear divider) to base 16 when the contents of compartment 15 are heavy and base 16 is handled near the other compartments.

Figure 11:
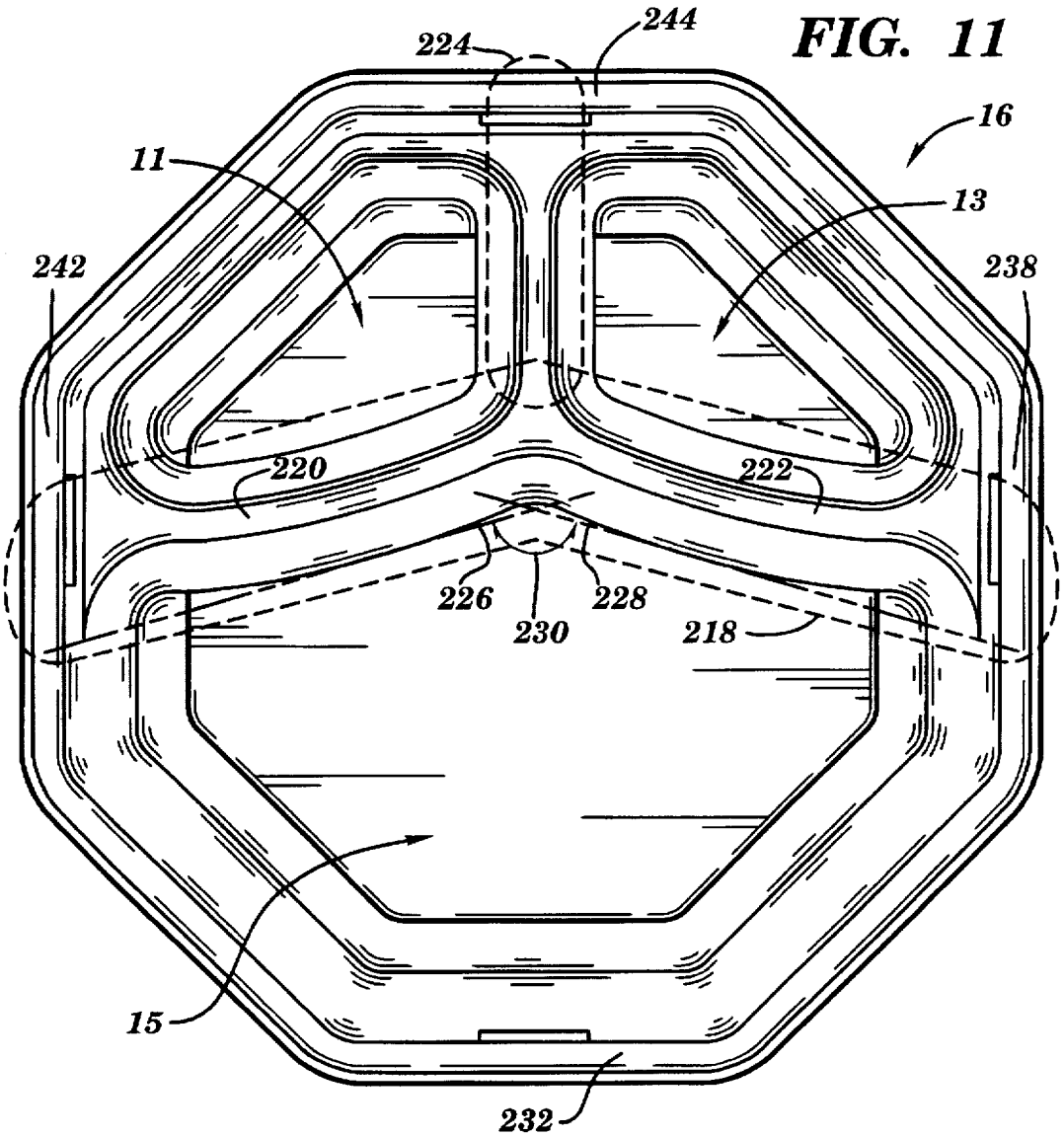
FIG. 11 is a top view of the container base of FIG. 1.

FIG. 11 is a top view of base 16 of container 10 from FIG. 1. As indicated previously, base 16 includes a first compartment 215, a second compartment 211 and a third compartment 213. Compartment 215 is separated from compartments 211 and 213 by nonlinear divider 218, which includes segments 220 and 222. As shown in the present exemplary embodiment, compartment 215 has a larger compartment area than either compartment 211 or 213. Compartments 211 and 213 are separated by a second divider 224 coupled to nonlinear divider 218 where segments 220 and 222 meet.

Although base 16 could be comprised of any suitable material, for example, plastic, it is preferably thermoformed from a rigid foam. As used herein, the term "rigid foam" refers to any foam material suitable for forming containers of the type described herein, such as, for example, polystyrene foam.

As shown in FIG. 11, nonlinear divider 218 is bowed, as compared to a linear divider, such as an elongated version of divider 224. In this particular embodiment, segments 220 and 222 are each curved such that the normal lines 226 and 228 for the curves intersect to create an angle 230 of more than 90° and less than 180°. An angle of 90° or less would generally not result in the collapsing problem described above. However, it will be understood that the individual segments of the divider could be linear, so long as they are coupled to make a nonlinear divider. In that case, the relevant angle would be created by the segments themselves, rather than normal lines. It will also be understood that the term "nonlinear divider" is intended to encompass a single arc extending across the container, or a series of coupled segments (curved and/or linear) that together approximate a curve or arc. Preferably, angle 230 is between 105° and 170°. As will be shown and described in greater detail subsequently, the bowed nature of the nonlinear divider adds to the structural integrity of the container, as compared to a linear divider. In addition, the curved nature of the individual segments also aids in resisting container collapse, and, where the divider is segmented, is preferred over linear segments.

Figure 12:
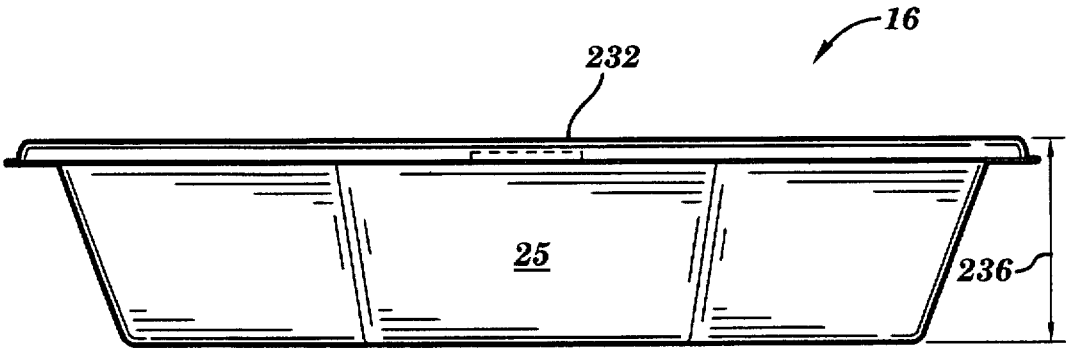
FIG. 12 is a front view of the container base of FIG. 1.

FIG. 12 is a front view of the base 16 of FIG. 11, taken along a side 232 adjacent to first compartment 15. Noncontinuous sidewall 25 is shown having a height 236. Sidewall 25 extends around the periphery of base 16, but has certain noncontinuous sections, as will be described in greater detail subsequently.

Figure 13:
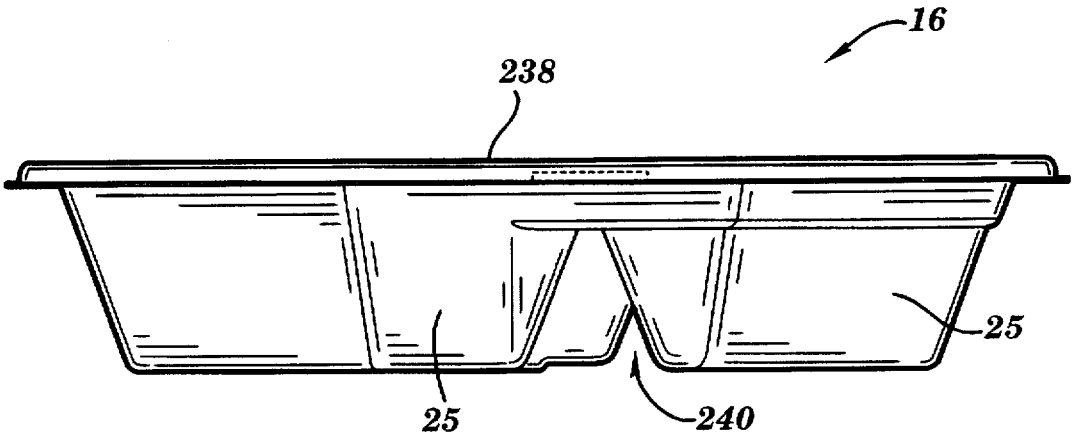
FIG. 13 is a right side view of the container base of FIG. 1.
Figure 14:
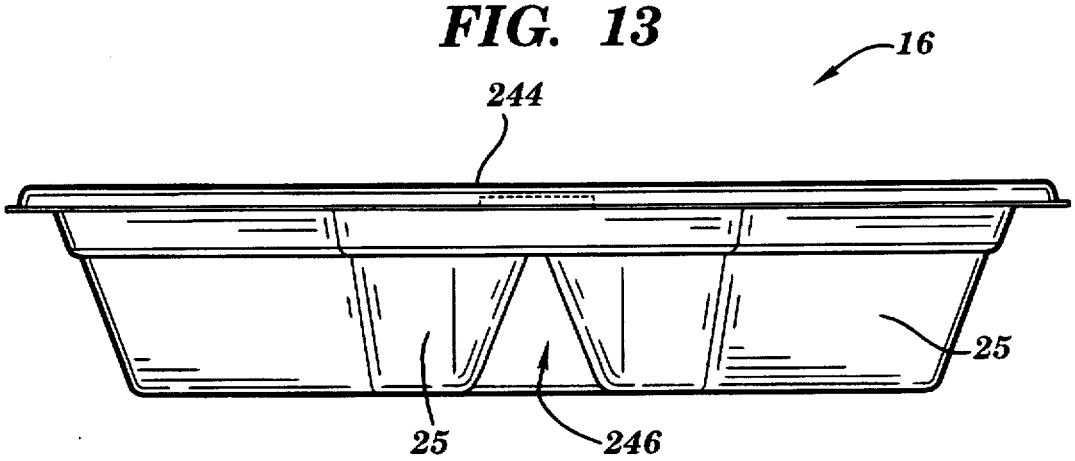
FIG. 14 is a rear view of the container base of FIG. 1.
Figure 15:
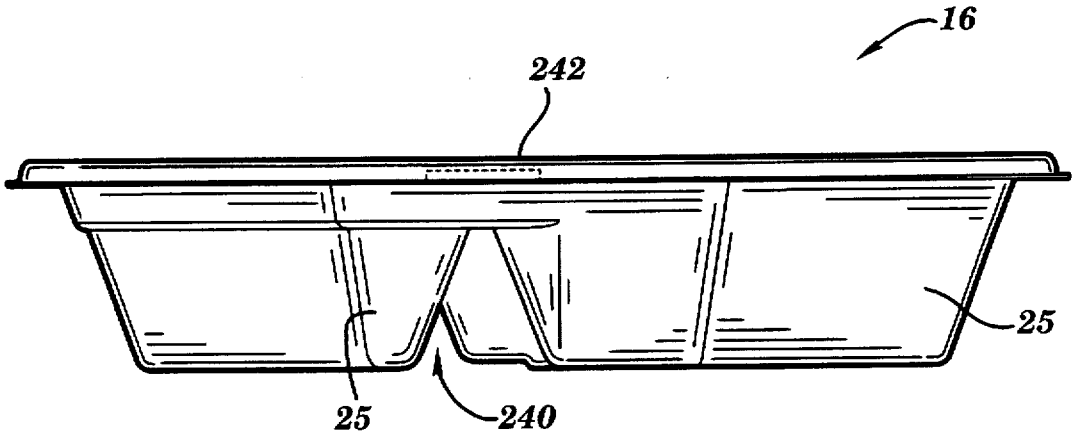
FIG. 15 is a left side view of the container base of FIG. 1.

FIGS. 13, 14 and 15 are right, back and left side views, respectively, of the base 16 of FIG. 11. FIG. 13 is taken along a side 238 of base 16, and shows a throughopening 240 extending from side 238 to side 242 of base 16. Preferably, base 16 is produced by some molding process, which creates nonlinear divider 218 and leaves behind the open area that is throughopening 240. Thus, the shape of the noncontinuous divider corresponds to the shape of the throughopening. Due to throughopening 240, sidewall 25 is noncontinuous; that is, there are breaks therein. FIG. 14 is taken along a side 244 of base 16, and shows a second throughopening 246 corresponding to divider 224. FIG. 15 is taken along side 242 of base 16, and shows the container from the other side of throughopening 240.

Figure 16:
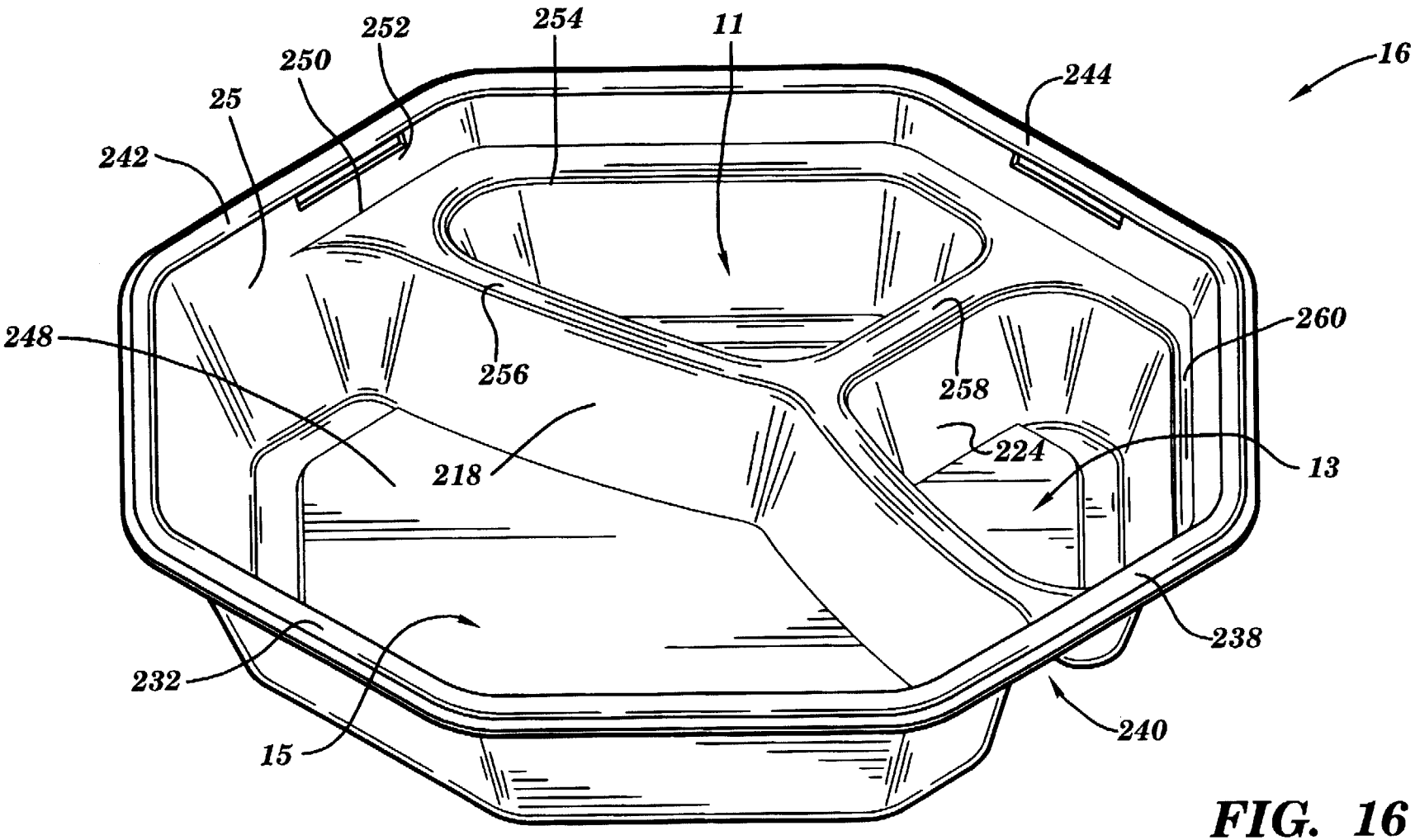
FIG. 16 is a perspective view from above the container base of FIG. 1.

FIG. 16 is a perspective view of base 16. As shown in FIG. 16, nonlinear divider 218 extends up from a noncontinuous bottom surface 248 (shown more clearly in FIG. 17) to an area 250 of noncontinuous sidewall 25, a distance equal to about three quarters of the height 236 of noncontinuous sidewall 25. This leaves a portion 252 of the sidewall above nonlinear divider 218 that is continuous across that portion of sidewall 25. The combination of portion 252 of the sidewall above the divider being left intact and a bowed divider generally provides enough structural integrity to prevent a container collapse under a reasonable load. However, for relatively light loads, the bowed divider alone may be sufficient, allowing the divider height to approach that of the adjacent sidewall.

As an example, assume base 16 is used to hold food, and a chicken quarter were placed in compartment 15, but the base were held with one hand at side 244. If divider 218 were linear, area 252 alone may not provide enough structural integrity to prevent a collapse, since the linear nature of the divider would lend itself to folding under load. However, as area 252 grows in size (and the height of the divider decreases correspondingly), it may reach a size where it alone can provide enough support for the weight of the chicken quarter. For many purposes, it has been found that this size is reached where the divider height is about half the height of the sidewall or less. However, the shorter the divider, the more shallow the compartments will be, which may be undesirable for some purposes. By bowing the divider in accordance with the present invention, the divider height can remain high, above half the height of the sidewall adjacent thereto, allowing for deep compartments.

Figure 17:
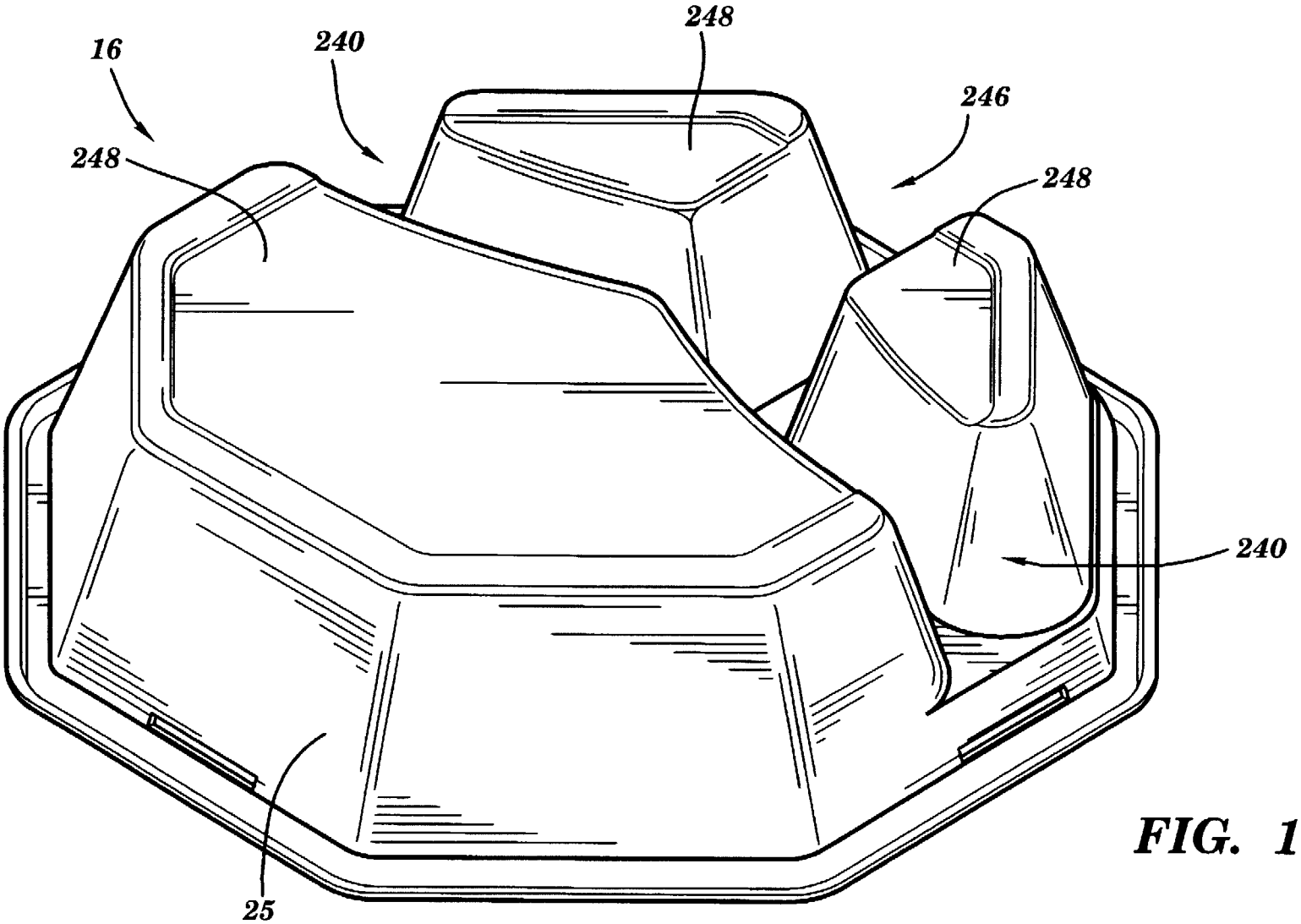
FIG. 17 is a perspective view from below the container base of FIG. 1.

FIG. 17 is a perspective view of the underside of base 16. Shown more clearly in FIG. 17 is noncontinuous bottom 248, the noncontinuous feature thereof resulting from throughopenings 240 and 246.

Figure 18:
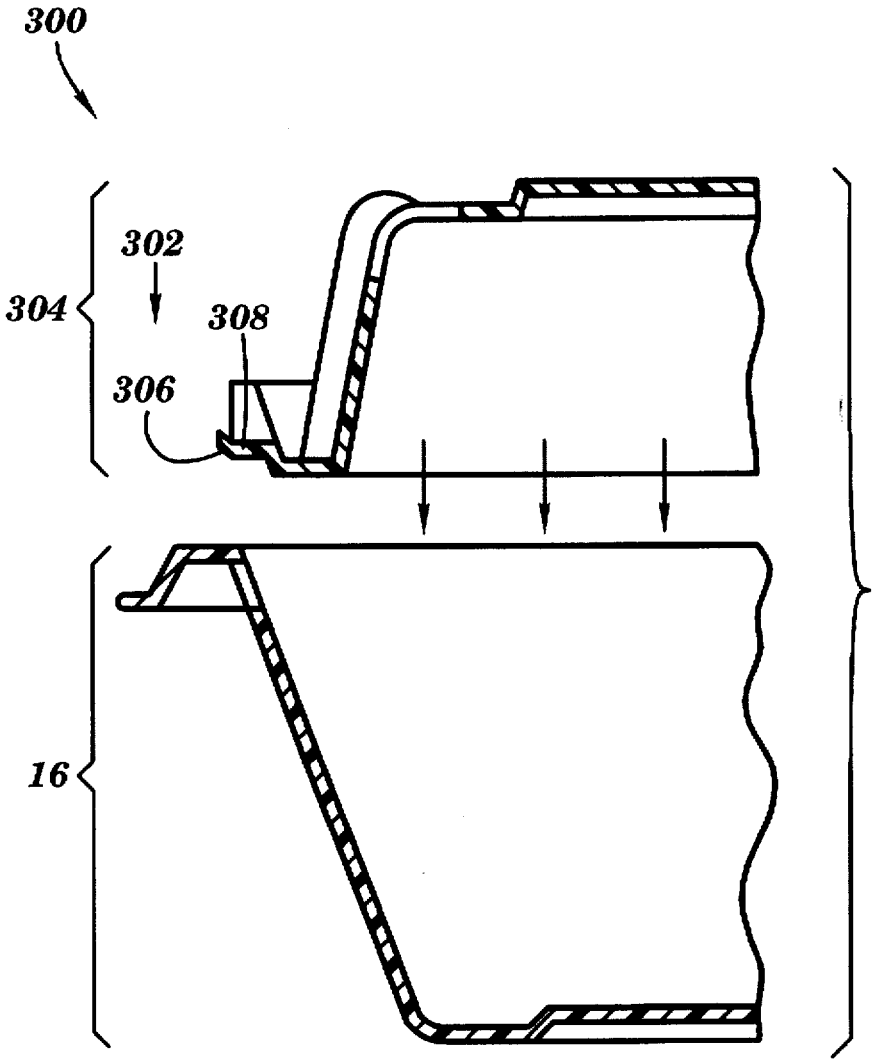
FIG. 18 is cross-sectional view of an alternate closure according to the present invention.

FIG. 18 is a partial cross-sectional view of a container 300 according to the present invention taken along an alternate closure 302. Container 300 is identical to container 10 of FIG. 1, except for the closures, e.g., closure 302, and includes cover 304 and base 16 from FIG. 1. Closure 302 is similar to closure 12 of FIG. 3, except that closure 302 includes an angled extension 306 out from depressed rim area 308. Extension 306 is only about ¼ the width of depressed rim area 308, and is angled upward to both encourage closure and discourage unwanted or accidental removal of cover 304 from base 16.

Although base 16 and covers 14 and 304 have been depicted herein with an octagon shape, they could be shaped differently, for example, round or square. In addition, it will also be understood that nonlinear divider 218 could be bowed the opposite way than what is shown in the figures.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

We claim:

1. A compartmentalized container, comprising:

a base comprising at least two compartments; and means for covering the base such that when at least one compartment of the at least two compartments has content, the content is substantially retained within the at least one compartment during a perturbation of the container, wherein the means for covering includes a plurality of raised areas inward and separated from a periphery of the covering means for pressing the covering means down onto the base to seal the compartmentalized container, each raised area having a roughened surface.

2. A compartmentalized container, comprising:

a base comprising at least two compartments; and means for covering the base such that when at least one compartment of the at least two compartments has content, the content is substantially retained within the at least one compartment during a perturbation of the container, wherein one of the base and covering means includes a first sidewall having an outwardly extending rim coupled thereto at a periphery thereof, the outwardly extending rim including a vertical indentation therein, and the other of the base and the covering means including a second sidewall having a fixed opening therein for receiving the vertical indentation, wherein the covering means and the base are releasably connected when the opening receives the vertical indentation.

3. The container of claim 2, wherein the vertical indentation includes an angled extension.

4. The container of claim 2, wherein the one of the covering means and the base further includes a lifting extension.

5. The container of claim 2, wherein the covering means comprises the outwardly extending rim, and wherein the vertical indentation comprises a depression of the outwardly extending rim.

6. The container of claim 2, wherein the one of the base and covering means further comprises a channel connecting the first sidewall and the outwardly extending rim.

7. The container of claim 6, wherein the other of the base and covering means further includes a rim extending outward from the second sidewall at a periphery thereof, and wherein a non-indentation portion of the outwardly extending rim of the one of the base and covering means rests above the rim of the base when the opening receives the vertical indentation.

8. A compartmentalized container, comprising:

a base comprising at least two compartments; and means for covering the base such that when at least one compartment of the at least two compartments has content, the content is substantially retained within the at least one compartment during a perturbation of the container, wherein one of the base and covering means includes a first sidewall having an outwardly extending rim coupled thereto at a periphery thereof, the outwardly extending rim including an indentation therein, and the other of the base and the covering means including a second sidewall having a fixed opening therein for receiving the indentation, wherein the covering means and the base are releasably connected when the opening receives the indentation, and wherein the covering means comprises the outwardly extending rim, and wherein the indentation takes the form of a depression of the outwardly extending rim, wherein the cover further comprises a channel connecting the first sidewall and the outwardly extending rim.

9. The container of claim 8, wherein the base further includes a rim extending outward from the second sidewall at a periphery thereof, and wherein a non-indentation portion of the outwardly extending rim of the cover rests above the rim of the base when the opening receives the indentation.

* * * * *